US009611861B2

(12) United States Patent
Kim et al.

(10) Patent No.: US 9,611,861 B2
(45) Date of Patent: Apr. 4, 2017

(54) WASHING MACHINE

(71) Applicant: SAMSUNG ELECTRONICS CO., LTD., Suwon-si (KR)

(72) Inventors: Hyun Joo Kim, Gwangju (KR); Eung Ryeol Seo, Suwon-si (KR); Hoon Wee, Youngin-si (KR); Jin Ki Lee, Suwon-si (KR); You Eok Jeon, Suwon-si (KR); Kwang Kyu Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 538 days.

(21) Appl. No.: 14/188,904

(22) Filed: Feb. 25, 2014

(65) Prior Publication Data

US 2014/0377071 A1 Dec. 25, 2014

(30) Foreign Application Priority Data

Jun. 21, 2013 (KR) ..... 10-2013-0071917

(51) Int. Cl.

| | |
|---|---|
| ***F04D 29/28*** | (2006.01) |
| ***D06F 39/00*** | (2006.01) |
| ***D06F 25/00*** | (2006.01) |
| ***D06F 37/00*** | (2006.01) |
| ***F04D 29/30*** | (2006.01) |
| *D06F 37/30* | (2006.01) |
| *D06F 23/04* | (2006.01) |
| *D06F 37/20* | (2006.01) |

(52) U.S. Cl.

CPC ..... *F04D 29/282* (2013.01); *D06F 25/00* (2013.01); *D06F 37/00* (2013.01); *D06F 39/00* (2013.01); *F04D 29/30* (2013.01); *D06F 23/04* (2013.01); *D06F 37/206* (2013.01); *D06F 37/30* (2013.01); *F04D 29/281* (2013.01)

(58) Field of Classification Search

CPC ..... F04D 29/281; F04D 29/282; F04D 29/30; D06F 37/206; D06F 37/30

USPC ..... 416/183, 185, 223 B, 235, 237, 229 R; 68/58, 140

See application file for complete search history.

(56) References Cited

U.S. PATENT DOCUMENTS

| | | | | |
|---|---|---|---|---|
| 4,922,151 A * | 5/1990 | Lewis | D06F 37/206 | 310/91 |
| 5,707,209 A * | 1/1998 | Iyer | F04D 29/30 | 416/186 R |
| 7,866,952 B2 * | 1/2011 | Tanahashi | F04D 29/281 | 416/223 B |

(Continued)

FOREIGN PATENT DOCUMENTS

| | | |
|---|---|---|
| KR | 1998-0008219 | 4/1998 |
| KR | 1998-031816 | 8/1998 |
| KR | 2002-0024076 | 3/2002 |

*Primary Examiner* — Christopher Besler

(74) *Attorney, Agent, or Firm* — Staas & Halsey LLP

(57) ABSTRACT

A washing machine having a centrifugal fan which may increase a discharge flow rate. The washing machine includes a centrifugal fan adapted to cool a motor, wherein the centrifugal fan comprises a circular plate connected to a shaft of the motor, and a plurality of blades radially arranged around a center of the circular plate, each of the blade includes an inlet portion extending to form an inlet for external air passing therethrough, and a guide bent and inclined from the inlet portion, and an outlet portion bent from the guide to form an outlet for the external air.

7 Claims, 9 Drawing Sheets

(56) References Cited

U.S. PATENT DOCUMENTS

2006/0216139 A1* 9/2006 Chang ..... F04D 29/283
415/53.1

* cited by examiner

WASHING MACHINE

CROSS-REFERENCE TO RELATED APPLICATIONS

This application claims the benefit of Korean Patent Application No. 10-2013-0071917, filed on Jun. 21, 2013 in the Korean Intellectual Property Office, the disclosure of which is incorporated herein by reference.

BACKGROUND

1. Field

The following description relates to a washing machine including a centrifugal fan which may increase a discharge flow rate.

2. Description of the Related Art

A washing machine, which uses electric power to wash clothing, generally includes a tub to retain washing water, a rotary tub rotatably installed in the tub, a pulsator rotatably installed at the bottom of the rotary tub, and a power transmission unit to selectively transfer rotational power of a driving motor to the rotary tub or pulsator.

Korean Patent Application Publication No. 10-2002-0004043 discloses an example of a power transmission unit of the above washing machine. A clutch device disclosed in this document receives power from the motor through a pulley and transfer the power to the shaft of the pulley such that the rate of rotation of the motor is reduced by a reduction gear unit and transferred to a washing shaft to rotate the pulsator connected to the washing shaft clockwise or counterclockwise to perform operations of washing.

While washing and drying operations are preformed, heat may produced in the motor. To cool the motor, a centrifugal fan may be installed at the pulley of the motor, and the fan and pulley rotate clockwise and counterclockwise together with a motor rotating shaft.

When the temperature of the motor exceeds a predetermined temperature, for example, due to lack of flow rate, the motor may stop rotating until the temperature drops below the predetermined temperature and then performs rotation.

Accordingly, the entire time taken to perform washing may be increased due to cooling of the motor by the centrifugal fan.

SUMMARY

Therefore, it is an aspect of the present disclosure to provide a washing machine including a centrifugal fan which may improve the cooling efficiency of a motor of the washing machine by increasing the discharge flow rate.

It is another aspect of the present disclosure to provide a washing machine including a centrifugal fan having an improved structure to increase the flow rate.

Additional aspects of the disclosure will be set forth in part in the description which follows and, in part, will be apparent from the description, or may be learned by practice of the disclosure.

In accordance with one aspect of the present disclosure, a washing machine includes a centrifugal fan to cool a motor, wherein the centrifugal fan comprises a circular plate connected to a shaft of the motor, and a plurality of blades radially arranged around a center of the circular plate, at least one of the plurality of blades includes an inlet portion extending to form an inlet for external air to pass therethrough, and a guide bent and inclined from the inlet portion, and an outlet portion bent from the guide to form an outlet for the external air.

The inlet portion may extend in a radial direction of the circular plate to be directed to a center of the shaft.

The outlet portion may extend in the radial direction of the circular plate to be directed to the center of the shaft.

A radial line extending outward from the center of the shaft to the inlet portion may not coincide with a direction in which the inlet portion extends.

A radial line extending outward from the center of the shaft to the outlet portion may not coincide with a direction in which the outlet portion extends.

An angle formed between a radial line extending outward from the center of the shaft and the guide may be between about 25° and about 45°.

At least one of the plurality of blades further comprises an embossed portion to reinforce the blade during rotation of the blade.

The embossed portion may be formed on the circular plate.

Two neighboring ones of the blades may form one pair.

At least one of the plurality of blades may further include a bent portion perpendicularly bent from the guide to be fixed to the circular plate.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
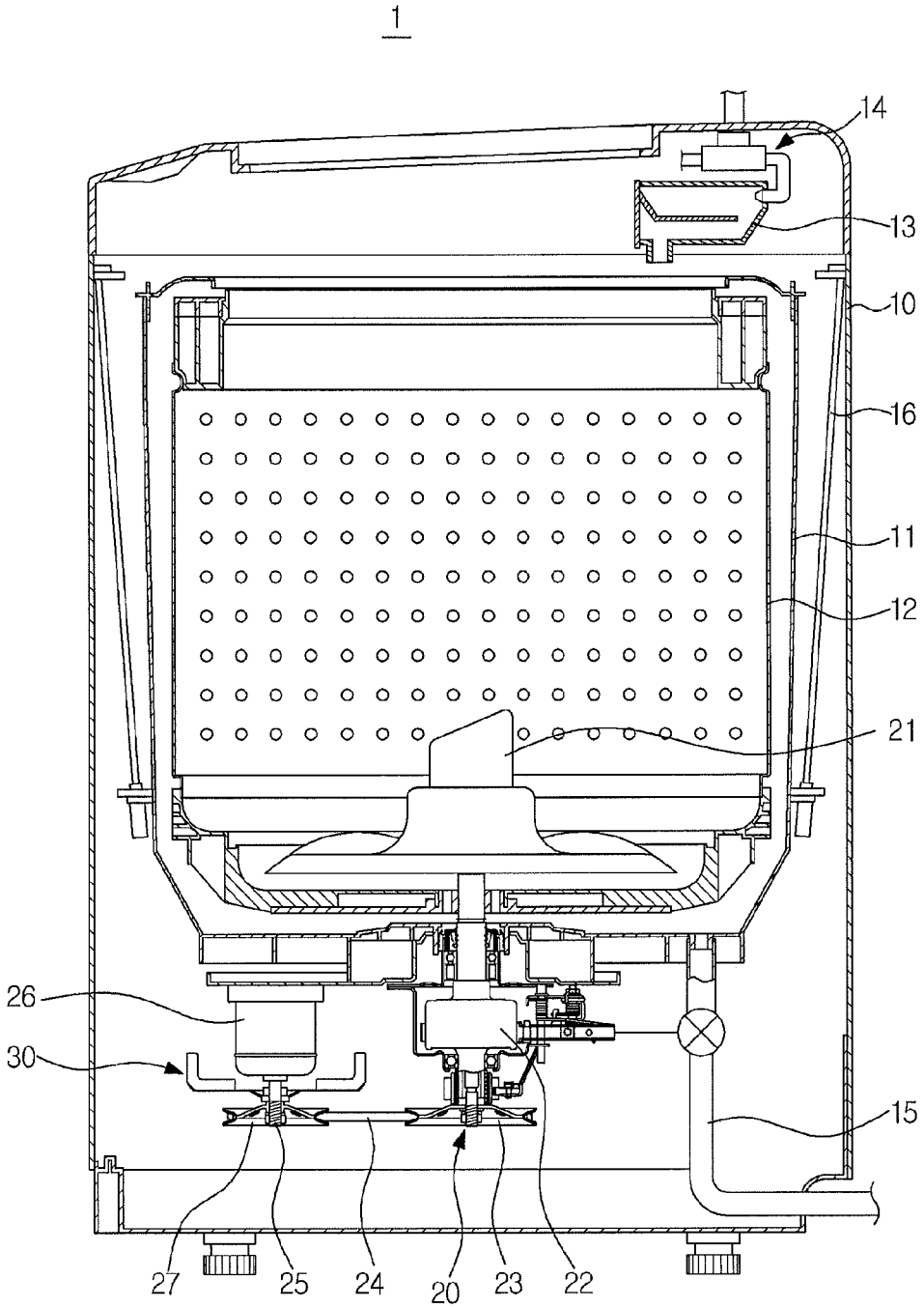
FIG. 1 is a view schematically showing a washing machine according to an exemplary embodiment of the present disclosure.

Reference will now be made in detail to embodiments of the present disclosure, examples of which are illustrated in the accompanying drawings, wherein like reference numerals refer to like components throughout.

FIG. 1 is a view schematically showing a washing machine according to an exemplary embodiment of the present disclosure.

As shown in FIG. 1, the washing machine 1 includes a tub 11 installed in a body 10, a rotary tub 12 rotatably installed in the tub 11, and a pulsator 21 rotatably installed at a lower portion of the inside of the rotary tub 12.

The tub 11 may be supported by a plurality of suspensions 16 caught by the inner upper portion of the body 10.

A water supply unit 14 to supply washing water into the tub 11 is installed at the upper portion of the tub 11, and a water discharge unit 15 to discharge the washing water from the tub 11 is at the lower portion of the tub 11.

Washing water introduced via the water supply unit 14 is supplied into the rotary tub 12 via a detergent case 13.

A driving unit 20 is provided at the lower portion of the tub 11 to rotate the pulsator 21 and rotary tub 12.

The driving unit 20 may include a motor 26, a rotating shaft 25 of the motor 26, a motor pulley 27 connected to a lower portion of the rotating shaft 25 to transfer driving force to the rotating shaft 25, a clutch 22 connected to the pulsator 21, a clutch pulley 23 connected to the clutch 22, and a belt 24 to connect the motor pulley 27 with the clutch pulley 23.

In addition, a centrifugal fan 30 to cool the motor 26 is provided at the motor pulley 27 which is at the lower portion of the motor.

Hereinafter, a brief description will be given of washing and drying operations by a washing machine configured as above.

When electric power is applied for washing, the motor 26 rotates. The rotational power of the motor 26 is transferred to the pulsator 21 via the motor pulley 27 and the clutch pulley 23 connected with the motor pulley 27 by the belt 24. As the pulsator 21 is rotated clockwise and counterclockwise by the rotational power of the motor 26, water streams are produced to perform the washing operation.

For example, in the drying operation, the rotary tub 12 and the pulsator 21 rotate together.

Figure 2:
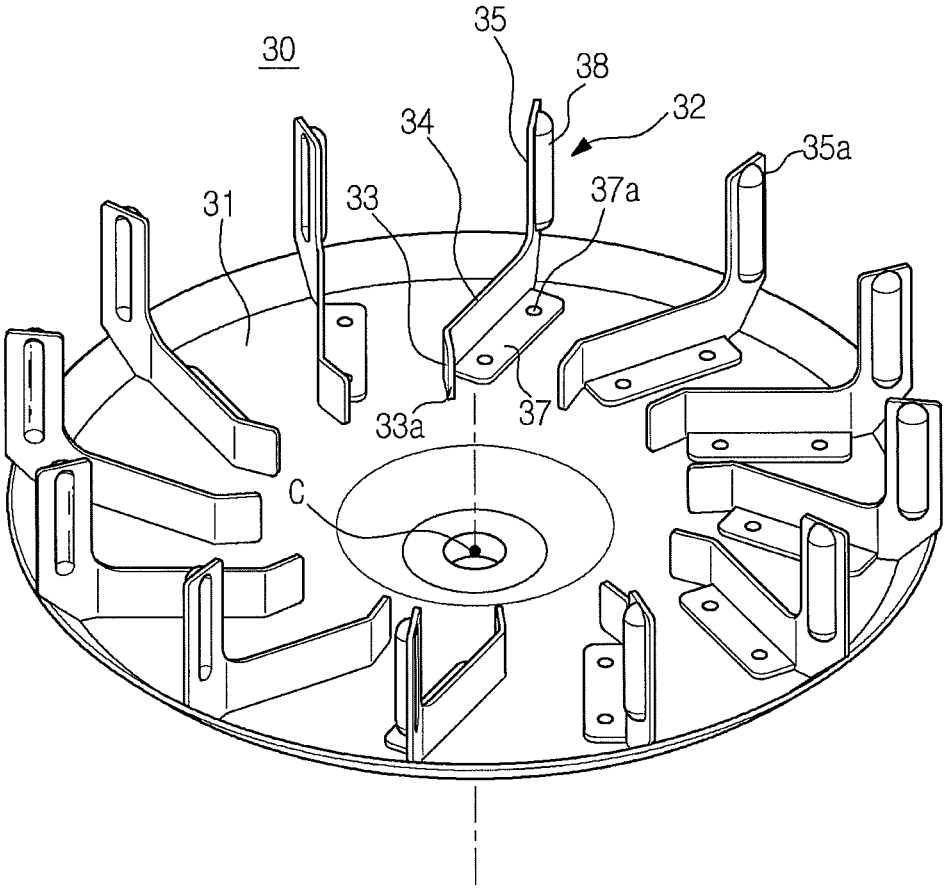
FIG. 2 is a perspective view showing a centrifugal fan of a washing machine according to an embodiment of the present disclosure.
Figure 3:
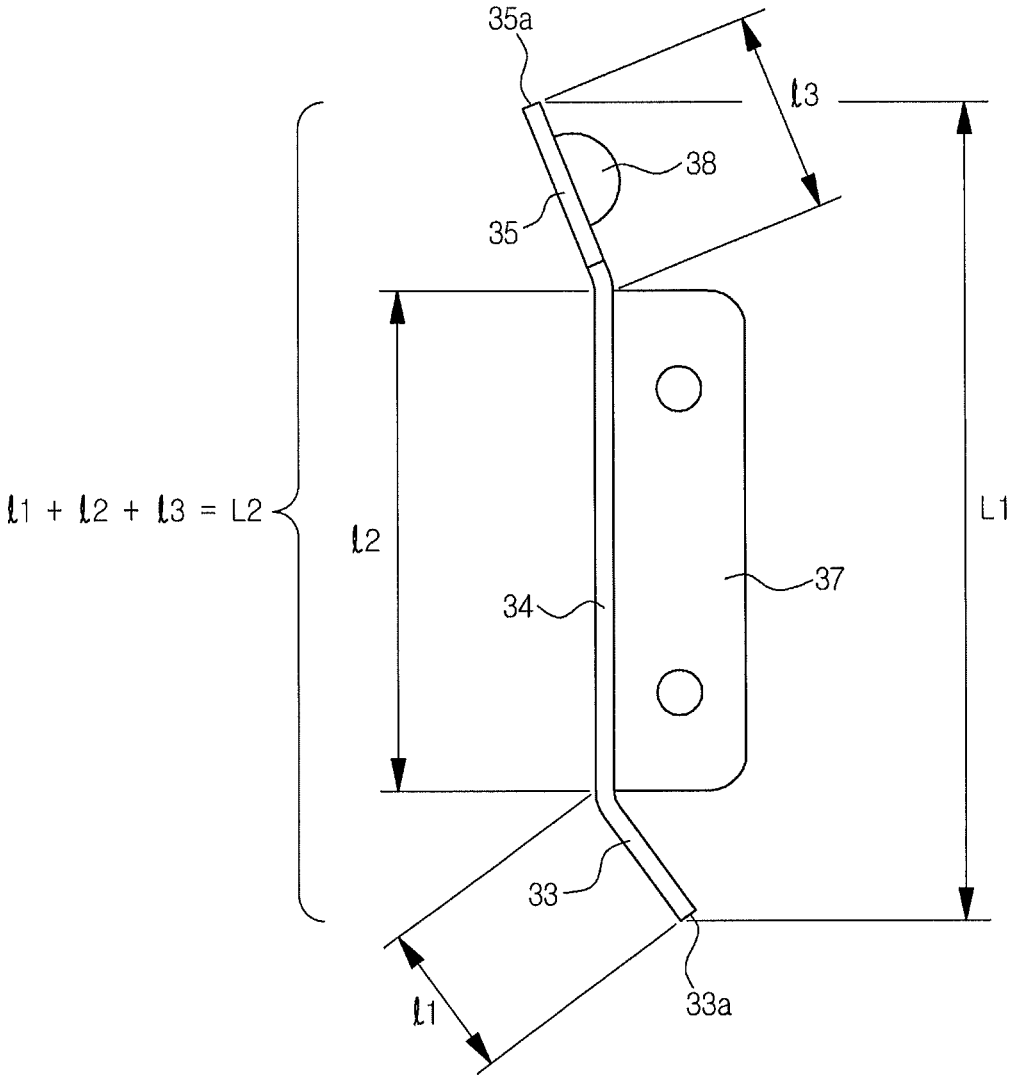
FIG. 3 is a perspective view schematically showing a blade according to an embodiment of the present disclosure.
Figure 4:
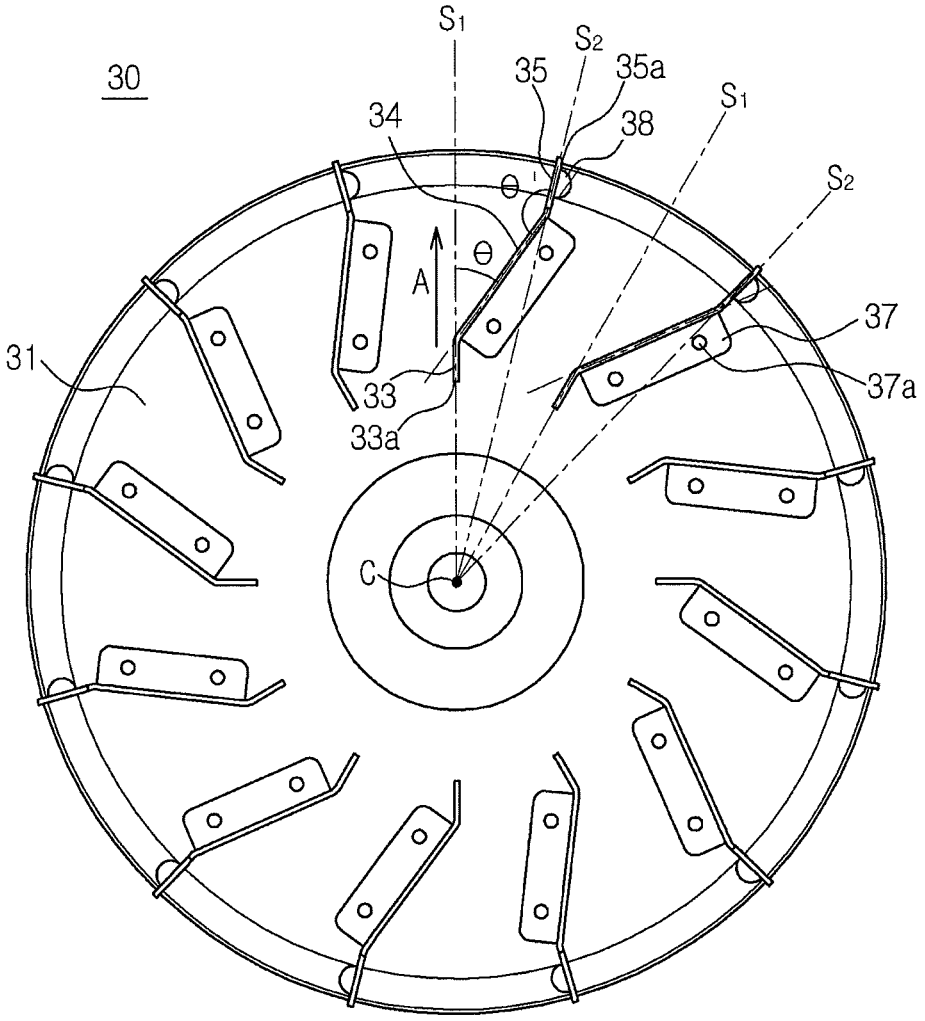
FIG. 4 is a plan view schematically showing the centrifugal fan of FIG. 2.

FIG. 2 is a perspective view showing a centrifugal fan of a washing machine according to an embodiment of the present disclosure, FIG. 3 is a perspective view schematically showing a blade according to an embodiment of the present disclosure, and FIG. 4 is a plan view schematically showing the centrifugal fan of FIG. 2.

Figure 5:
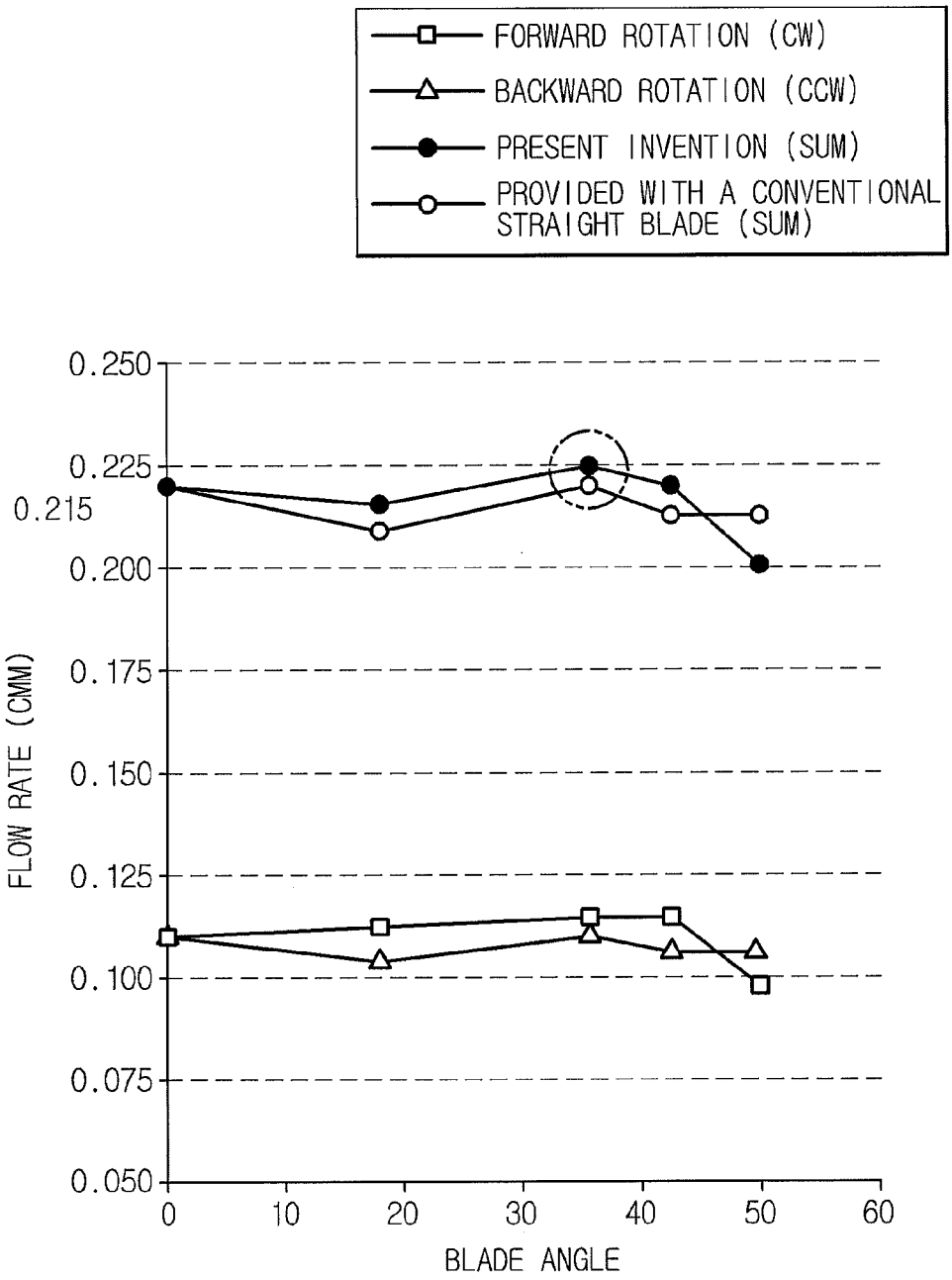
FIG. 5 is a graph showing a result of experiment for flow rate of a centrifugal fan provided with the blade of FIG. 3.
Figure 6:
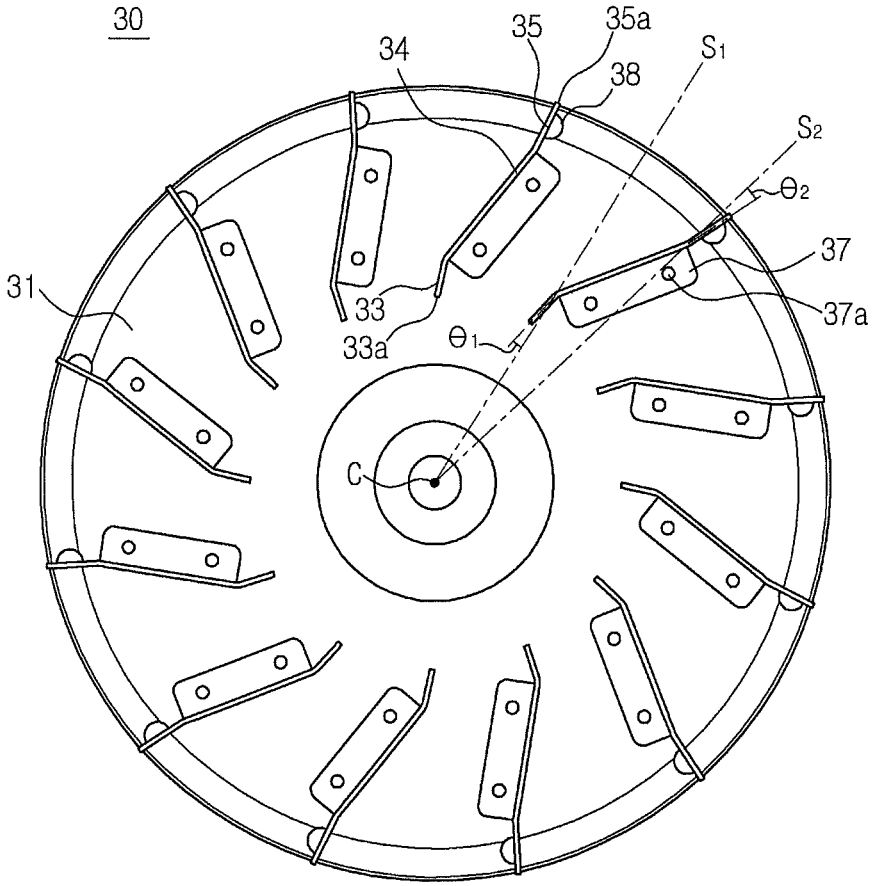
FIG. 6 is a plan view schematically showing a centrifugal fan according to another embodiment of the present disclosure.

FIG. 5 is a graph showing a result of experiment for flow rate of a centrifugal fan provided with the blade of FIG. 3, and FIG. 6 is a plan view schematically showing a centrifugal fan according to another embodiment of the present disclosure.

As shown in FIGS. 2 to 6, the centrifugal fan 30 may be connected to the motor pulley 27 to dissipate the heat produced in the motor 26 in operation.

The centrifugal fan 30 includes a circular plate 31 in a circular shape connected to the rotating shaft 25, and at least one blade 32 radially arranged from the shaft center C of the circular plate 31.

In an illustrated embodiment, twelve blades 32 are provided as an example. However, the spirit of the present disclosure is not limited thereto. For example, one or more blades may be provided. The number of the blades may be adjusted to avoid resonance causing the noise to increase when the centrifugal fan rotates. For example, six, eight, eleven or thirteen blades 32 may be provided.

The blade 32 may include an inlet portion 33 arranged to extend from the inner end 33*a* of the blade 32 in a radial direction A of the centrifugal fan 30 to form an inlet of introduced external air, a guide 34 bent from the inlet portion 33 and inclined to guide the air, and an outlet portion 35 provided at the outer end 35*a* of the blade 32 to be bent from the guide 34 to form an outlet of the discharged air.

The inlet portion 33 and the outlet portion 35 respectively extend in a radial direction A of the circular plate 31 to be directed toward the shaft center C.

The inlet portion 33 is arranged to coincide with a radial line S1 extending outward from the shaft center C such that the inlet angle between the inlet portion 33 of the blade 32 and the radial line S1 is about 0°. The outlet portion 35 is arranged to coincide with a radial line S2 extending outward from the shaft center C such that the outlet angle between the outlet portion 35 of the blade 32 and the radial line S2 is about 0°.

In addition, the guide 34 may be arranged such that a guide angle θ of between about 25° and about 45° is formed between the inlet portion 33 and the outlet portion 35.

Herein, by setting the inlet angle of the inlet portion 33 and the outlet angle of the outlet portion 35 to about 0°, the same flow rate may be produced in any direction during forward and backward rotation of the centrifugal fan 30.

A brief description of operation of the blade 32 configured as above is given below.

When the centrifugal fan 30 provided with a plurality of blades 32 having the inlet angle and the outlet angle of 0° and the guide angle θ of about 35°, is rotated according to rotation of the motor 26, the air introduced through the space between the blades 32 may interact with the blades 32 to produce the same discharge flow rate at the inlet portion 33 and the outlet portion 35 of each of each blade 32 during forward rotation of the centrifugal fan 30.

In the section formed at the guide 34 extending the inlet portion 33 of the blade 32 at about 35° with respect to the inlet portion 33, discharge flow rate is increased as the blade 32 extends due to inclination of the guide 34.

The blade 32 of the illustrated embodiment may have a blade length L2, which is the sum of a length l1 of the inlet portion 33, a length l3 of the outlet portion 35, and a length l2 of the guide 34.

Since the blade length L2 of the blade 32 with the inclined guide 34 is greater than a length L1 of the blade 32 (a height of the blade 32) would have when the inlet portion 33 and the outlet portion 35 are connected in a straight line, the discharge flow rate of air may relatively increase.

The discharged air having passed along the guide 34 may be discharged through the outlet portion 35 in a centrifugal direction of the circular plate 31.

Accordingly, the discharge flow rate is constant at the inlet portion 33 of the blade 32 and the outlet portion 35, and increases at the guide 34.

FIG. 5 is a graph showing a result of test for flow rate in a centrifugal fan provided with a blade according to an embodiment of the present disclosure (Blade No. 3) and in a centrifugal fan provided with a conventional straight blade (Blade No. 1), according to the blade angle. (See also Table 1 below).

In the case of the conventional straight blade (Blade No. 1), the inlet angle, outlet angle, and guide angle are all 0°. In the case of the blade according to an illustrated embodiment of the present disclosure (Blade No. 3), the inlet angle and outlet angle are about 0°, and the guide angle is about 35.6°, for example.

Herein, for example, the diameter of the circular plate is set to about 148 mm for both the conventional straight blades and the blades for the purpose of the comparison according to an illustrated embodiment.

The experiment shows that the conventional straight blade (Blade No. 1) having the guide angle of 0° produces the same flow rate of 0.110 CMM (Cubic Meter per Minute) in both forward and backward rotation (see Table 1).

On the other hand, in the case of the blade of an illustrated embodiment (Blade No. 3) having the guide angle of about 35.6°, the produced flow rate is 0.114 CMM in the forward rotation, which is about 4% higher than the flow rate produced by the conventional straight blade.

In the backward rotation of the blade of an illustrated embodiment, the produced flow rate is 0.110 CMM, which is the same as that of the conventional straight blade (Blade No. 1).

Accordingly, when the sum of the flow rates produced in forward and backward rotation by the conventional straight blade (Blade No. 1) is compared with that of the blade of an illustrated embodiment (Blade No. 3), it is proven that the blade of an illustrated embodiment (Blade No. 3) produces a larger flow rate than the conventional straight blade (Blade No. 1).

TABLE 1

Flow rate produced in forward and backward rotation by the blade according to guide angle (in CMM)

| | Guide angle (°) | Forward rotation | Backward rotation | Sum |
|---|---|---|---|---|
| 1 (Conventional centrifugal fan) | 0 | 0.110 | 0.110 | 0.220 |
| 2 | 18 | 0.112 | 0.104 | 0.216 |
| 3 (Centrifugal fan of an illustrated embodiment) | 35.6 | 0.114 | 0.110 | 0.224 |
| 4 | 42.6 | 0.114 | 0.106 | 0.220 |
| 5 | 49.6 | 0.097 | 0.106 | 0.203 |

As shown in Table 1, when the guide angle of the blade is about 35.6°, high flow rate is produced. When the guide angle of the blade is equal to or greater than about 35.6°, however, the flow rate produced in backward rotation decreases is lowered and thus the total flow rate is lowered. The decrease in flow rate in one direction of rotation (backward direction) may degrade the cooling performance of the motor.

Therefore, for the blade (Blade No. 3) having an increased discharge flow rate in the forward rotation (clockwise) of the centrifugal fan 30 and the same discharge flow rate in the backward rotation (counterclockwise) as the conventional blade to produce an increased discharge flow rate as a whole, the inlet angle and the outlet angle may be about 0° and the guide angle may be about 35.6°.

The blade 32 may further include an embossed portion 38 to increase the strength of the blade 32 during rotation. The embossed portion 38 may be formed to protrude from one side of the outlet portion 35.

In an embodiment, the embossed portion 38 is illustrated as being formed at the outlet portion 35 of the blade 32. However, the spirit of the present disclosure is not limited thereto. The embossed portion 38 may be formed, for example, at the guide 34 of the blade 32 or the inlet portion 33, and at the circular plate 31.

The blade 32 further includes a bent portion 37 perpendicularly bent from the guide 34 to be fixed to the circular plate 31. The bent portion 37 includes a coupling hole 37*a* adapted to be coupled to the circular plate 31. While the blade 32 is illustrated in this embodiment as being coupled to the circular plate 31 through the coupling hole 37*a*, the spirit of the present disclosure is not limited thereto. The bent portion 37 may be coupled through, for example, caulking or welding.

In an illustrated embodiment, the inlet portion 33 and the outlet portion 35 extend in a radial direction of the circular plate 31 to face the shaft center C, thereby having the inlet angle θ1 and outlet angle θ2 of about 0°. However, the spirit of the present disclosure is not limited thereto. The inlet angle θ1 and outlet angle θ2 may alternatively be formed to be different from each other.

For example, as shown in FIG. 6, the direction of extension of the inlet portion 33, which is arranged to extend in the radial direction A of the circular plate 31, may not coincide with the radial line S1 extending outward from the shaft center C, but may form a predetermined inlet angle θ1 with respect to the radial line S1.

In addition, the direction of extension of the outlet portion 35 may not coincide with the radial line S2 extending outward from the shaft center C, but may form a predetermined outlet angle θ2.

The guide 34 may be connected between the inlet portion 33 and the outlet portion 35 to form the guide angle θ with respect to the radial line S1 extending outward from the shaft center C.

Herein, the inlet angle θ1 and outlet angle θ2 of the blade 32 may be different from the guide angle θ.

The guide 34 may be formed to have different inclinations (slopes) with respect to the inlet portion 33 and the outlet portion 35 of the blade 32.

For example, when the inlet angle θ1 and outlet angle θ2 at the inlet and outlet of the blade 32 are about 0° such that the inlet portion and the outlet portion are arranged in the shaft center C of the circular plate 31, the guide angle θ of the guide 34 with respect to the radial line S1 extending outward from the shaft center C may be between about 25° and about 45°.

In addition, the guide 34 may form different angles θ and θ' with the inlet portion 33 and the outlet portion 35 (see FIG. 4).

Figure 7:
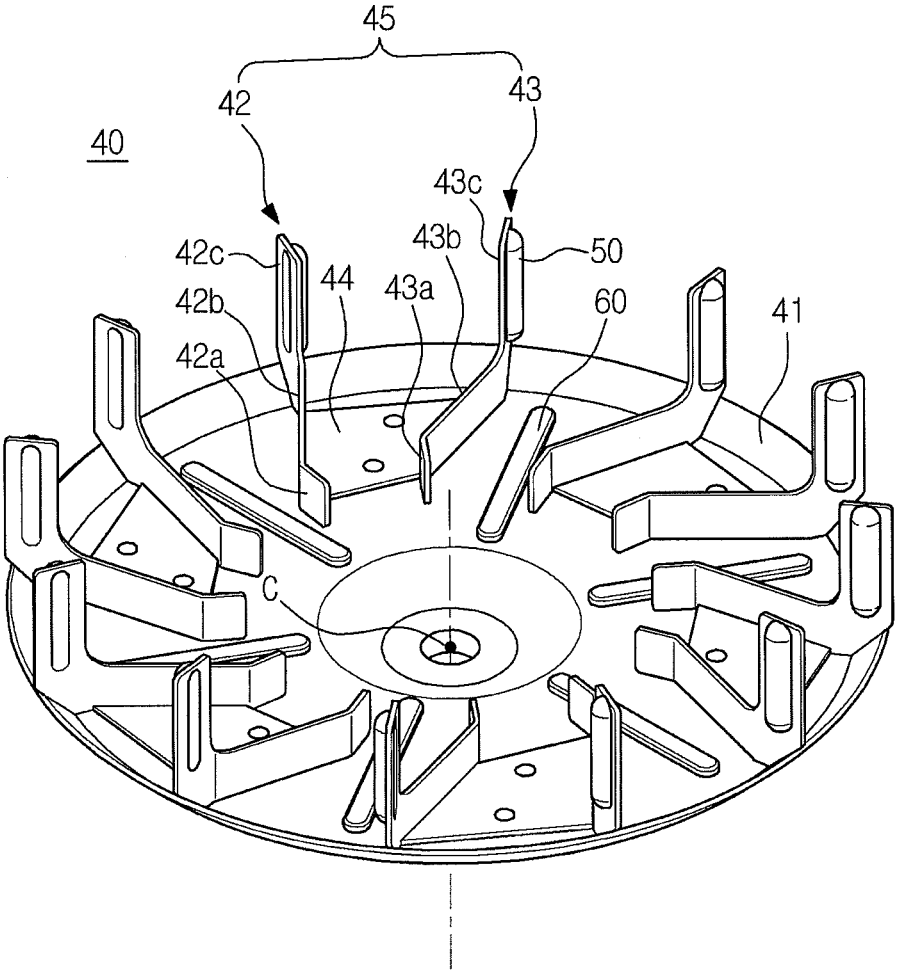
FIG. 7 is a perspective view schematically showing a centrifugal fan according to another embodiment of the present disclosure.
Figure 8:
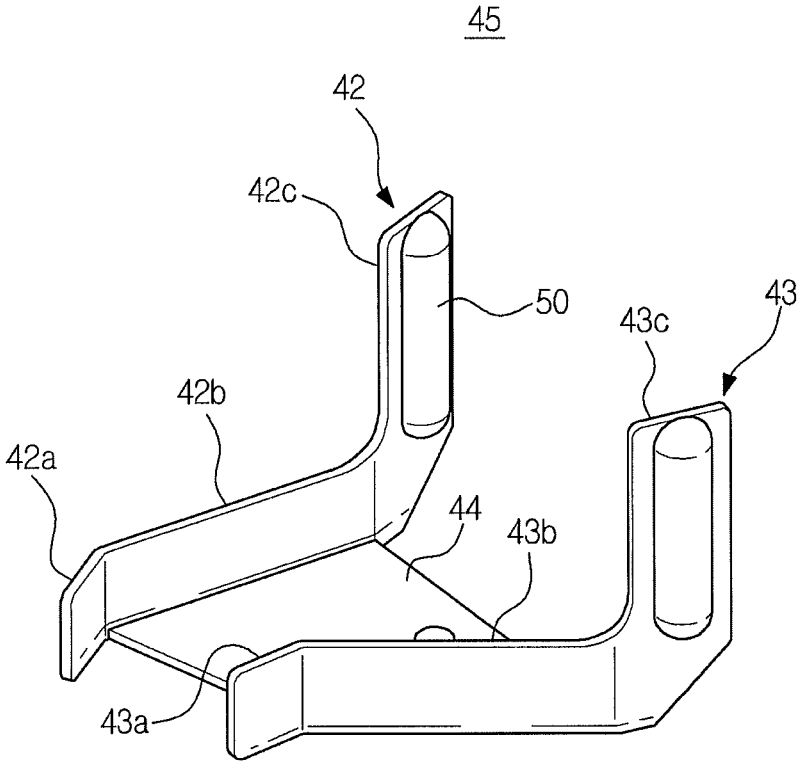
FIG. 8 is a perspective view schematically showing a blade of the centrifugal fan of FIG. 7.
Figure 9:
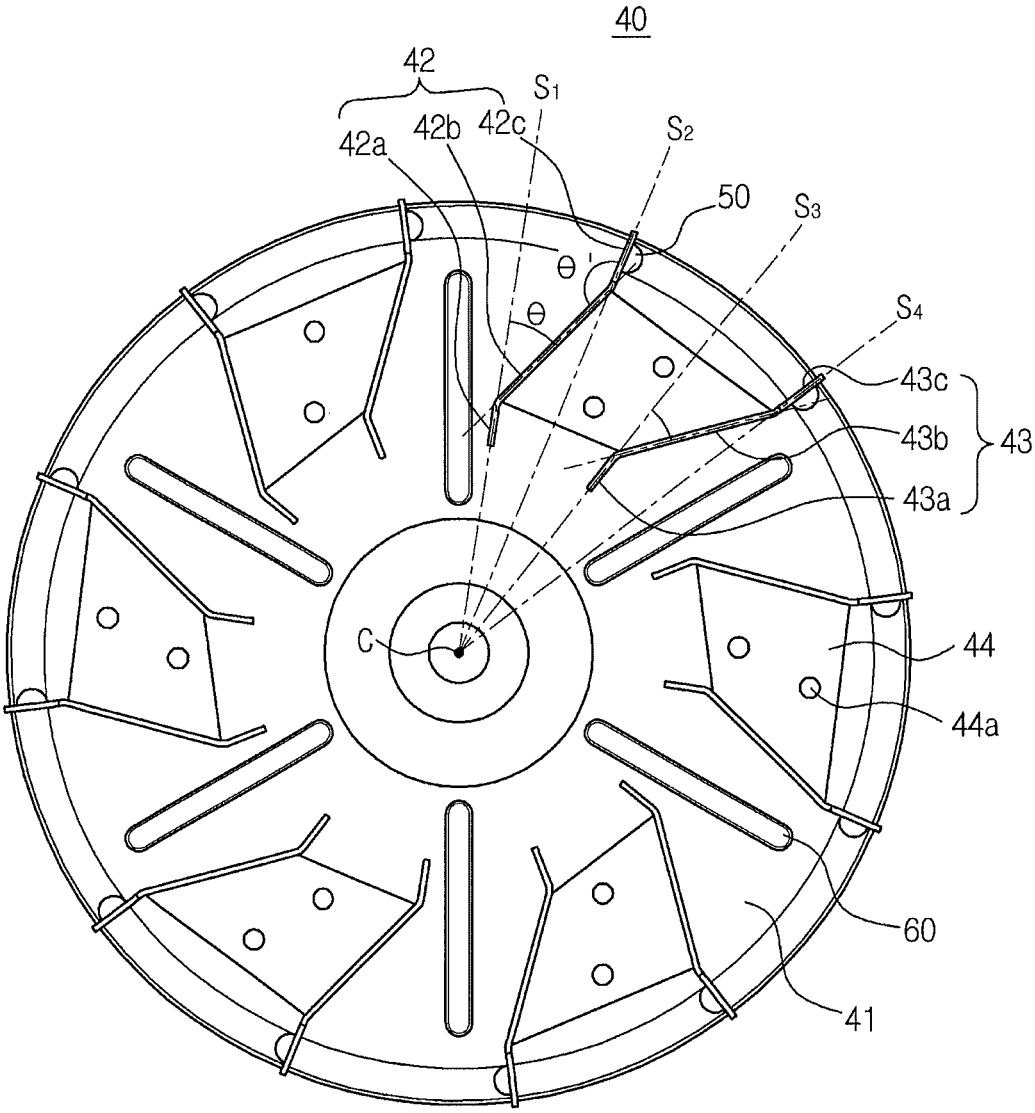
FIG. 9 is a plan view schematically showing the centrifugal fan of FIG. 7.

FIG. 7 is a perspective view schematically showing a centrifugal fan according to another embodiment of the present disclosure, FIG. 8 is a perspective view schematically showing a blade of the centrifugal fan of FIG. 7, and FIG. 9 is a plan view schematically showing the centrifugal fan of FIG. 7.

FIGS. 7 to 9 show a blade 45 applied to a centrifugal fan 40 according to another embodiment of the present disclosure.

At least one blade 45 radially disposed at a circular plate 41 connected to the motor pulley 27 may include a first blade 42, and a second blade 43 connected to the first blade 42 via a bent portion 44.

The first blade 42 and the second blade 43 may respectively include inlet portions 42*a* and 43*a* arranged at inner ends of the first blade 42 and the second blade 43 to form an inlet of introduced external air, guides 42*b* and 43*b* bent from the inlet portions 42*a* and 43*a* and inclined to guide the air, and outlet portions 42*c* and 43*c* provided at the outer ends of the first blade 42 and the second blade 43 to be bent from the guides 42*b* and 43*b* to form an outlet of the discharged air.

The inlet portions 42*a* and 43*a* and outlet portions 42*c* and 43*c* respectively extend in a radial direction A of the circular plate 41 to be directed toward the shaft center C. The inlet portions 42*a* and 43*a* are arranged to respectively coincide with radial lines S1 and S3 extending outward from the shaft center C, and the outlet portions 42*c* and 43*c* are arranged to respectively coincide with radial lines S2 and S4 extending outward from the shaft center C. Thereby, the inlet angles and outlet angles formed by the inlet portions 42*a* and 43*a* and outlet portions 42*c* and 43*c* may be about 0°.

Herein, the guides 42*b* and 43*b* are provided to respectively connect the inlet portion 42*a* to the outlet portion 42*c* and the inlet portion 43*a* to the outlet portion 43*c*. The guides 42*b* and 43*b* may include a guide angle θ formed between the radial lines S1 and S2 extending outward from the shaft center C and the guides 42*b* and 43*b*, respectively.

Operation of the first and second blades 42 and 43 including the inlet portions 42*a* and 43*a*, the outlet portions 42*c* and 43*c*, and the guides 42*b* and 43*b* as above are easily predictable from the blade 32 of the previous embodiment and thus a description thereof is omitted.

The bent portion 44 to connect the first blade 42 to the second blade 43 may be connected to the guides 42*b* and 43*b*.

The first blade 42 and second blade 43 may be integrated with each other. A coupling hole 44*a* to be coupled to the circular plate 41 is formed at the center of the bent portion 44. In an illustrated embodiment, the bent portion 44 is fixed to the circular plate 41 through the coupling hole 44*a*. However, the spirit of the present disclosure is not limited thereto. The bent portion 44 may be fixed to the circular plate 41 through, for example, caulking or welding.

The first blade 42 and second blade 43 may further include at least one embossed portion 50 and at least one embossed portion 60 to increase the strength of the first blade 42 and second blade 43 during rotation of the centrifugal fan 40. The embossed portions 50 and 60 include a first embossed portion 50 disposed at the outlet portions 42C and 43C of the first blade 42 and second blade 43, respectively and a second embossed portion 60 formed on the circular plate.

However, the present disclosure is not limited thereto. For example, the first embossed portion 50 may be formed at least one of the inlet portions 42*a* and 43*a*, guides 42*b* and 43*b*, and outlet portions 42*c* and 43*c* of the blade 45. The second embossed portion 60 may be formed on a portion of the circular plate 41 between the blades 45.

As is apparent from the above description, torsional strength and bending strength may be secured by the embossed portions 50 and 60 of the centrifugal fan 40.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

an outer tub disposed in a body of the washing machine to store water therein;

a rotatable tub disposed in the outer tub to accommodate laundries;

a pulsator rotatably disposed at a lower side of the rotatable tub;

a motor disposed under the outer tub to supply driving force to the pulsator;

a motor pulley connected to a shaft of the motor to transfer the driving force to the pulsator; and a centrifugal fan disposed between the motor and the motor pulley to cool the motor, the centrifugal fan including:

a circular plate connected to the shaft of the motor; and a plurality of blades radially arranged around a center of the circular plate, at least one of the plurality of blades including:

an inlet portion extending to form an inlet for external air to pass therethrough;

a guide bent and inclined from the inlet portion; and an outlet portion bent from the guide to form an outlet for the external air, wherein the inlet portion extends in a radial direction of the circular plate to be in line with a center of the shaft, and the outlet portion extends in the radial direction of the circular plate to be in line with the center of the shaft.

2. The washing machine according to claim 1, wherein an angle formed between a radial line extending outward from the center of the shaft and the guide is between about 25° and about 45°.

3. The washing machine according to claim 1, wherein the at least one of the plurality of blades further includes an embossed portion to reinforce the blade during rotation of the blade.

4. The washing machine according to claim 1, wherein an embossed portion is formed on the circular plate.

5. The washing machine according to claim 1, wherein two adjacent blades of the plurality of blades are integrally formed.

6. The washing machine according to claim 1, wherein the at least one of the plurality of blades further includes a bent portion perpendicularly bent from the guide to be fixed to the circular plate.

7. The washing machine according to claim 5, wherein the at least one of the plurality of blades further includes a bent portion bent from the guide to be fixed to the circular plate.

* * * * *